US010165809B2

(12) United States Patent
Tong

(10) Patent No.: US 10,165,809 B2
(45) Date of Patent: Jan. 1, 2019

(54) UPPER BODY GARMENT TO ACCOMMODATE MEDIAL EQUIPMENT DURING PROLONGED OR FREQUENT TREATMENTS

(71) Applicant: Alice Wai Yee Tong, Redmond, WA (US)

(72) Inventor: Alice Wai Yee Tong, Redmond, WA (US)

( * ) Notice: Subject to any disclaimer, the term of this patent is extended or adjusted under 35 U.S.C. 154(b) by 0 days.

(21) Appl. No.: 15/140,460

(22) Filed: Apr. 27, 2016

(65) Prior Publication Data

US 2016/0309811 A1 Oct. 27, 2016

Related U.S. Application Data

(60) Provisional application No. 62/153,500, filed on Apr. 27, 2015.

(51) Int. Cl.

| | |
|---|---|
| ***A41B 9/00*** | (2006.01) |
| ***A41D 10/00*** | (2006.01) |
| ***A41D 13/12*** | (2006.01) |

(52) U.S. Cl.

CPC ..... *A41D 13/1245* (2013.01); *A41D 13/129* (2013.01); *A41D 2300/30* (2013.01)

(58) Field of Classification Search

CPC ..... A41D 13/1236; A41D 13/1245; A41D 13/1254; A41D 2300/33; A41D 2300/50; A41D 2300/32; A41D 15/005

USPC ..... 2/114

See application file for complete search history.

(56) References Cited

U.S. PATENT DOCUMENTS

| | | | | |
|---|---|---|---|---|
| 2,374,643 | A * | 5/1945 | Boettcher | A41D 13/1236 2/114 |
| 4,995,115 | A * | 2/1991 | Ellis | A41D 13/1236 2/114 |
| 5,553,323 | A * | 9/1996 | Chou | A41D 13/129 2/105 |
| 5,564,123 | A * | 10/1996 | Grassick | A41D 13/1245 2/114 |
| 6,148,444 | A * | 11/2000 | Holmes | A41D 13/1245 2/114 |
| 6,694,521 | B1 * | 2/2004 | Hopkins | A41B 13/08 2/114 |
| 7,987,524 | B2 * | 8/2011 | Bower | A41D 13/1245 2/106 |
| 2010/0251456 | A1 * | 10/2010 | Bower | A41D 13/1245 2/114 |

(Continued)

*Primary Examiner* — Timothy K Trieu

(74) *Attorney, Agent, or Firm* — Law Office of Dorian Cartwright; Dorian Cartwright

(57) ABSTRACT

An upper body garment has a first access seam spanning a first sleeve of the garment on an underside from a cuff to an arm pit and spanning a body of the garment from the arm pit to a lower hem. The first access seam can be secured by magnets or other fasteners located intermittently along the sleeve and body which are easily opened for access to treatment areas. Furthermore, when the magnets are opened, the first access seam opens completely on one side of a patient body to peel away over IV needles and other connections for removal using a neck opening and a second sleeve. When the garment (or a new garment) is put back on by the patient through the neck and second sleeve, the first sleeve can be re-secured over connections to the body by rejoining opposing magnets.

10 Claims, 6 Drawing Sheets

(56) References Cited

U.S. PATENT DOCUMENTS

| | | | | |
|---|---|---|---|---|
| 2015/0033439 | A1* | 2/2015 | Dimotsantos ..... | A41D 13/1236 2/114 |
| 2015/0059048 | A1* | 3/2015 | Stanley ..... | A41D 13/129 2/69 |
| 2015/0101102 | A1* | 4/2015 | Theodossiou ..... | A41D 13/1254 2/114 |

* cited by examiner

UPPER BODY GARMENT TO ACCOMMODATE MEDIAL EQUIPMENT DURING PROLONGED OR FREQUENT TREATMENTS

CROSS-REFERENCES TO RELATED APPLICATIONS

This application claims the benefit priority under 35 U.S.C. § 119(e) of U.S. Patent App. No. 62/153,500, filed on Apr. 27, 2015, and entitled Upper Body Garment to Accommodate Medial Equipment During Prolonged or Frequent Treatments, by Alice TONG, the contents being hereby incorporated in its entirety.

FIELD OF THE INVENTION

The invention relates generally to medical garments, and more specifically, to an upper body garment that accommodates medical equipment during prolonged treatments.

BACKGROUND

For quick or temporary medical treatments, patients wearing street clothes can roll up their sleeves for access to arms, adjust a collar for access to the neck, and lift a lower hem for access to the torso. Access for a syringe needle shot or blood pressure reading can be completed quickly so clothing is not much of an issue.

However, street clothes can hinder access to areas of the body being undergoing longer or more frequent treatments. For example, doctors and nurses may need to access a central line for administration of medical treatment, administer intravenous therapy, or access diagnostic wires that transverse the skin. When adults and children need frequent medical treatment intravenous medicines, blood products and blood draws, it becomes more difficult as time progresses to find a usable vein. In one case, a central venous access line (or central line) is frequently accessed over a period of several years after placement in the patient as a permanent intravenous tube or catheter which can stay in place as long as it is needed. One type of central line, an internal line called a PORT-A-CATH is entirely under the skin and located in the upper chest, abdomen or groin area of a patient. An external line called a PICC (Peripherally Inserted Central Catheter) has tubing outside the skin. Both have a long thin tube reaching the large vein that goes to the heart. Another problem is that street clothes can be unsanitary and threaten the integrity of such medical processes. As a result, patients can change into a hospital gown made for easy access and removal.

Problematically, while hospital gowns maximize access, comfort can be minimized. Conventional gowns have wide sleeves also provide easy access, for example, for IV needles to be inserted and secured for prolonged treatments, and then ultimately removed. Also, gowns are typically completely open in the rear other than ties around the midriff of hip and sometimes the neckline, allowing a new gown to be changed into without disturbing any needles or other connections to the body. But the one-size-fits-all approach of hospital gowns and thinness of cotton material for frequent washes in hot water can leave patients feeling overexposed and chilly. The generic designs lack privacy and are unappealing to many, which can lend to a negative overall mental state that is potentially harmful to treatments.

Therefore, it is desirable to overcome these shortcomings with a robust upper body garment to accommodate medical equipment during prolonged or frequent treatments.

BRIEF SUMMARY OF THE DISCLOSURE

The shortcomings of the prior art are addressed by a garment and method of changing a garment that accommodate medical equipment during prolonged or frequent treatments.

In one embodiment, an upper body garment has a first access seam spanning a first sleeve of the garment on an underside from a cuff to an arm pit and spanning a body of the garment from the arm pit to a lower hem. The first access seam can be secured by magnets or other fasteners located intermittently along the sleeve and body which are easily opened for access to treatment areas. Furthermore, when the magnets are opened, the first access seam opens completely on one side of a patient body to peel away over IV needles and other connections for removal using a neck opening and a second sleeve. When the garment (or a new garment) is put back on by the patient through the neck and second sleeve, the first sleeve can be re-secured over connections to the body by rejoining opposing magnets.

In another embodiment, the upper body garment has a second access seam spanning a significant portion of a top side of the second sleeve. The second access seam can be secured by magnets or otherwise that does not completely open, allowing the garment to remain tethered to the patient body. By opening the second access seam, hospital staff is able to administer temporary or quick treatments in a manner similar to more wide-sleeved hospital gowns.

In yet another embodiment, the upper body garment is reversible such that a front and a back are arbitrarily reversed with respect to a front and a back of a patient's body. The first and second access seams can thereby be positioned depending on what part of the body is being treated.

Advantageously, an improved garment maintains the ease of access and interchangeability of hospital gowns, while providing the comfort and desirability of custom fitting. In other words, the garment provides the look and feel of street clothing which can be changed without help from caregivers.

DETAILED DESCRIPTION

Garments and methods of changing garments that accommodate medical equipment during prolonged or frequent treatments is disclosed. One of ordinary skill in the art will recognize variations of the examples given within, that are within the scope of the disclosure.

Figure 1A:
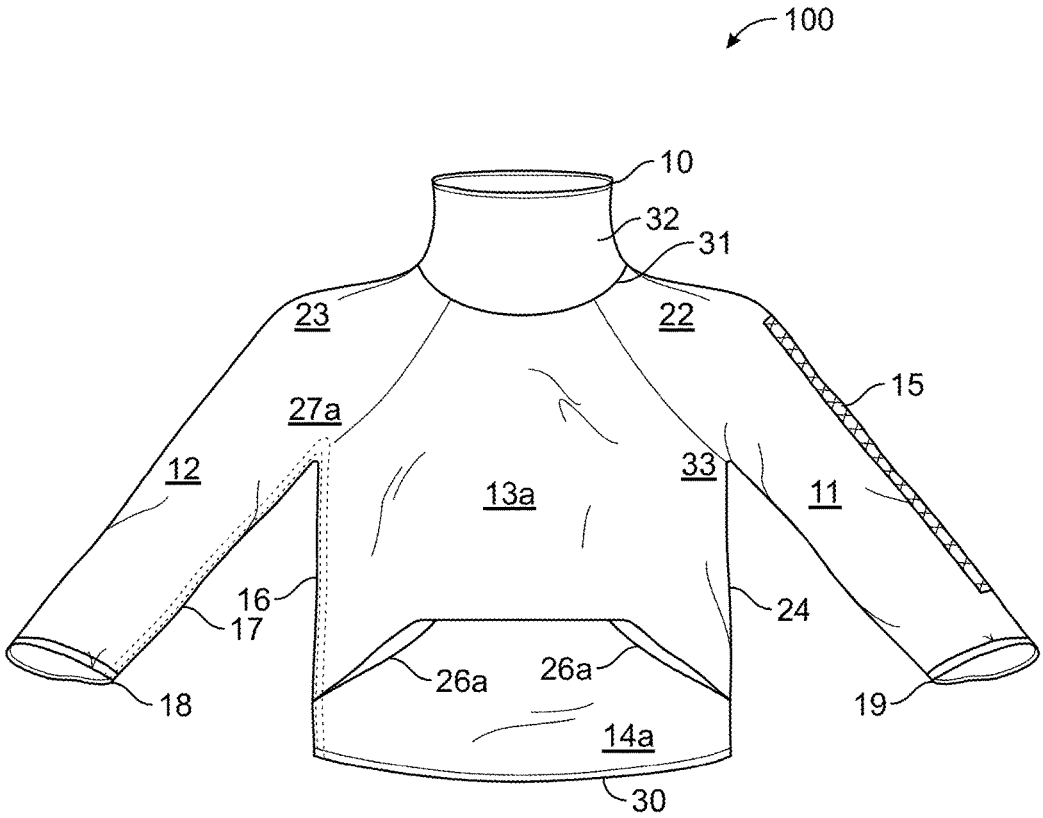
FIG. 1A is a schematic diagram illustrating a front view of an upper body garment having a first access seam and a second access seam, according to one embodiment.

FIG. 1A is a schematic diagram illustrating a front view of an upper body garment 100, according to one embodiment. The garment 100 can be a shirt, a jacket, a sweater, a sweatshirt, an undergarment, or the like. The garment 100 extends to a waistline of a patient in FIG. 1 but can be extended further. Sizes can be standard (e.g., small, medium, large, and extra-large) or custom fitted. The garment 100 can be used as street clothing as well, and can incorporate many aesthetic elements of fashion design. Any suitable material for hospitals is selected that is sanitary enough for treatments and also comfortable for extended use and temperatures. The garment 100 includes first and second sleeves 11,12, and a garment body 13*a*. The garment body 13*a* has a neckline 31 between shoulders 22,23 with a neck 32 and a neck opening 10.

In one embodiment, the garment 100 includes a first access seam 16, 17 spanning a first sleeve 12 on an underside from a cuff 18 at a distal end to an arm pit 27*a* and spanning a body 13*a* of the garment from the arm pit 27*a* to a lower hem 30 along a first lateral side of the body 13*a*. Placement of the first access seam 16, 17 can also be modified away from where traditional seams are located, for example, to an inch or two on either side and above the armpit 27*a* on either side. The first access seam 16, 17 can be secured by magnets located intermittently along the sleeve 12 and body which are easily opened for access to treatment areas. In other case, Velcro, snaps, buttons, zippers, or other appropriate mating fasteners are utilized. Some therapies involving medical lines can last for several days and necessitate a clothing change to prevent infection from accumulating germs. The medical lines located on the upper arm or chest of a patient can be accessed through the first access seam 16, 17 for initial connections or changes in connections. Moreover, some IVs are placed lower on the arm and area accessed through a different part of the first access seam. Thus, the first access seam 16, 17 can be partially opened at different locations.

Figure 1B:
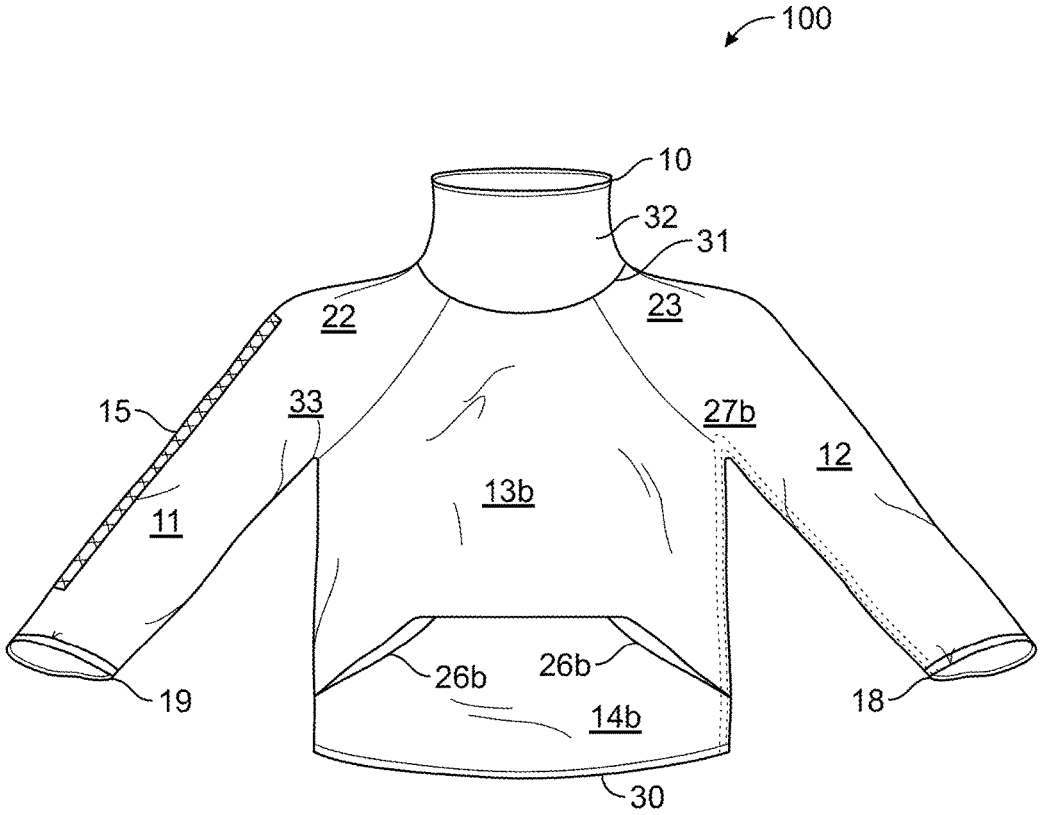
FIG. 1B is a schematic diagram illustrating a front view of the upper body garment in a reversed position having the first access seam and the second access seam on opposite sides relative to FIG. 1, according to one embodiment.

In yet another embodiment, the garment 100 is reversible as shown in FIG. 1B. In this case, a front 13*b* and a back (now 13*a*) are arbitrarily reversed with respect to a front and a back of a patient's body. The first and second access seams can thereby be positioned depending on what part of the body is being treated. In alternative embodiments, the garment 100 has a distinct front and a distinct rear without reversibility.

Figure 2A:
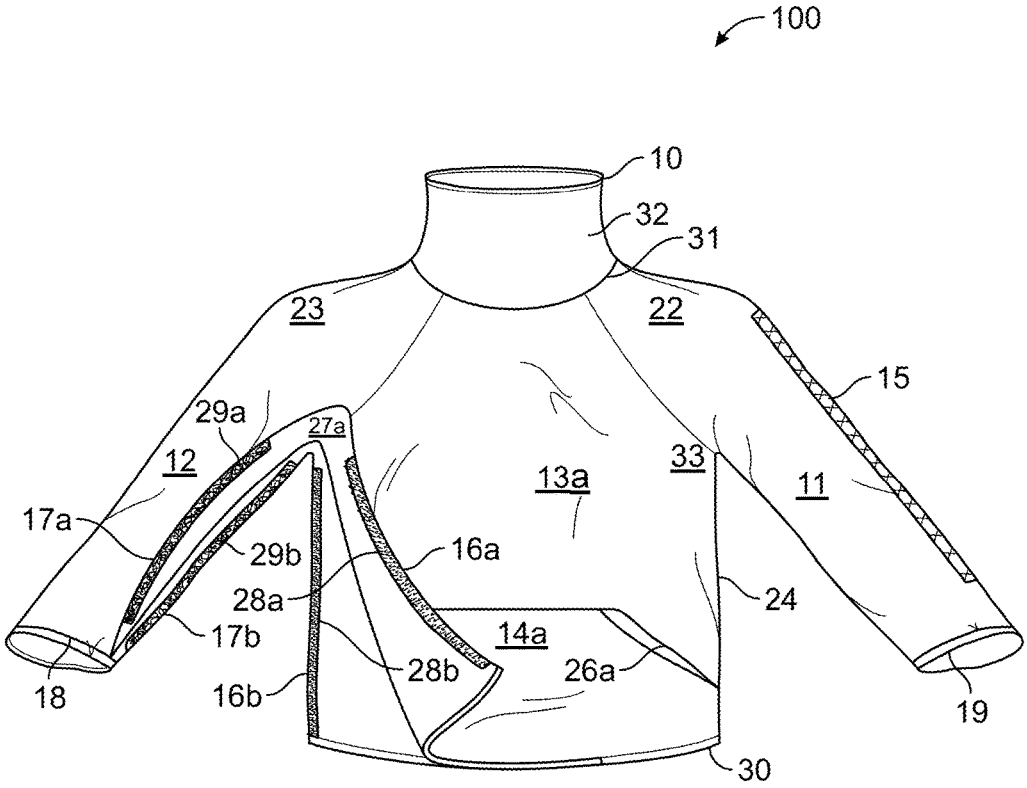
FIG. 2A is a schematic diagram illustrating the upper body garment with the first access seam in an open position for peeling away from a patient's body, according to one embodiment.
Figure 2B:
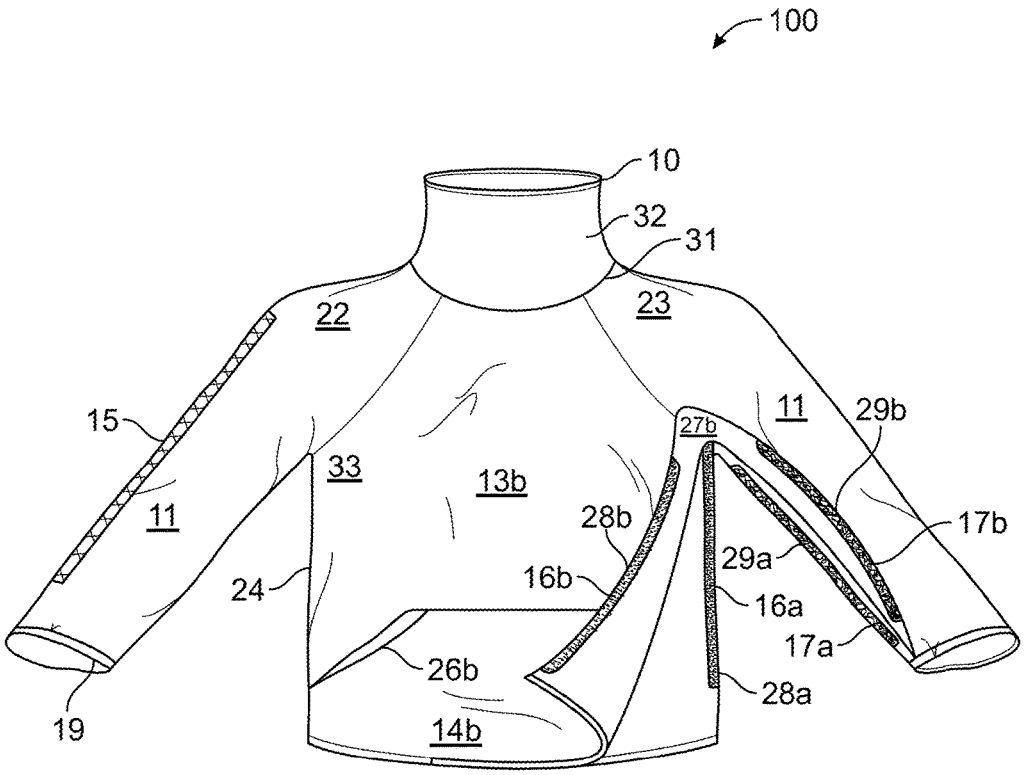
FIG. 2B is a schematic diagram illustrating the upper body garment in the reversed position with the first access seam in an open position for peeling away from the other side of a patient's body, according to an embodiment.

When a patient wants to take off the garment 100 for changing or washing, the magnets along the first access seam are opened as shown in FIG. 2A. The magnets are easily and independently manipulated by a patient with nerve damage or limited mobility. The complete opening allows the garment 100 to be peeled off of one side of a patient body to peel away over IV needles without removal. Even if IV needles can be removed and replaced to allow a clothing change, best practices to prevent infections dictate doing so as little as possible. When the garment (or a new garment) is put back on by the patient through the neck and a second sleeve 11, the first sleeve can be re-secured over connections to the body by rejoining opposing magnets. The garment 100 of FIG. 2B is shown open when in the reversed position.

Figure 3A:
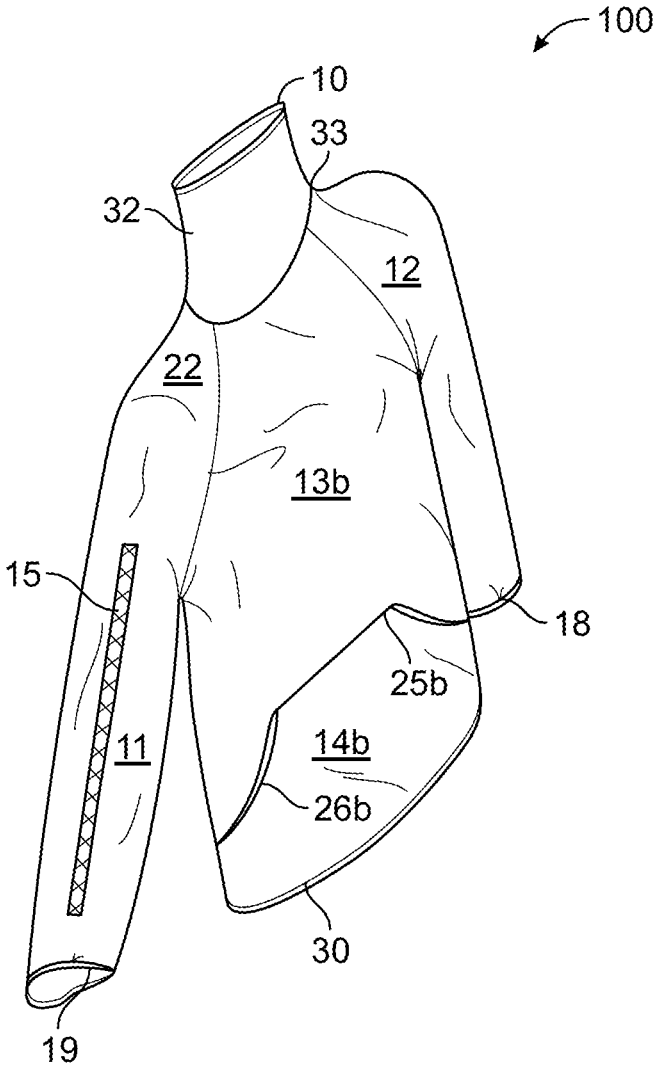
FIG. 3A is a schematic diagram illustrating a perspective view of the upper body garment with the second access seam in a closed position, according to an embodiment.
Figure 3B:
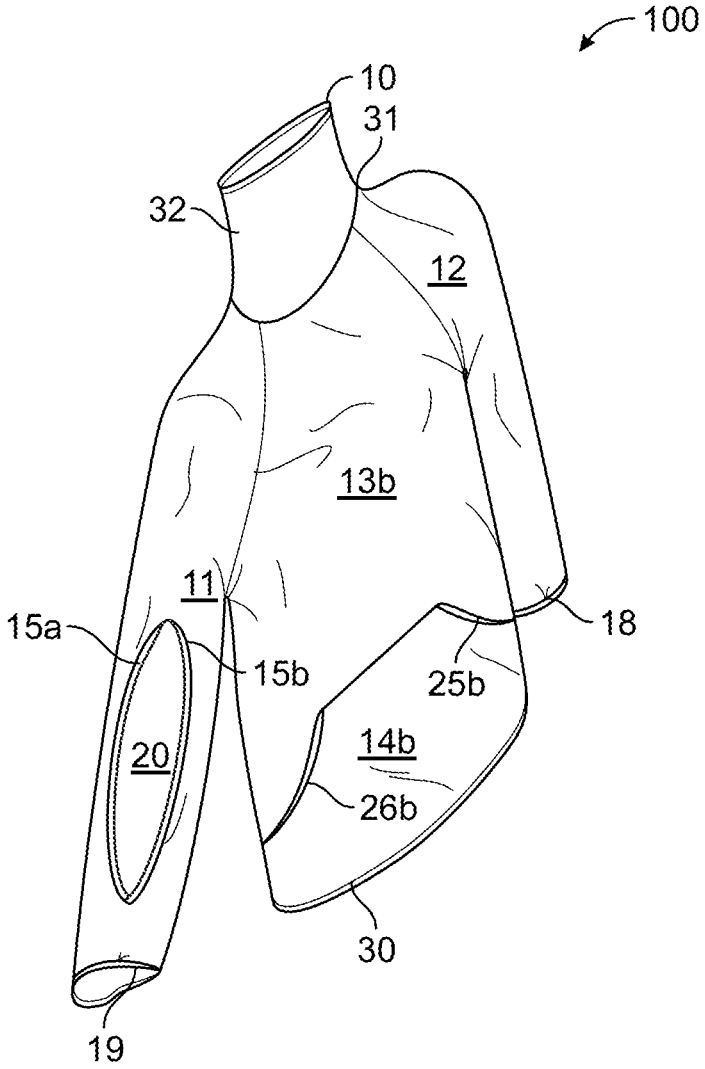
FIG. 3B is a schematic diagram illustrating a perspective view of the upper body garment with the second access seam in an opened position, according to an embodiment.

In one embodiment, the upper body garment has a second access seam 15 spanning a significant portion of a top side of the second sleeve 11 from a cuff 19 at a distal end to the neckline 31, wherein the significant portion comprises more than half of the top side of the second sleeve 11, and wherein the first and second cuffs are permanently tethered to prevent the first and second access seams spanning through the cuffs 18, 19, as shown in FIG. 3A. Similar to the first access seam 16, 17, different parts of the patient can be reached for blood pressure and other vital sign readings. The second access seam 15 can be secured by magnets or otherwise that does not completely open, allowing the garment to remain tethered to the patient body. Some cases use a more secure or smaller mechanism, such as buttons, on the second access seam 15, because someone other than the patient often opens and secures. By opening the second access seam as shown in FIG. 3B, hospital staff is able to administer temporary or quick treatments in a manner similar to more wide-sleeved hospital gowns.

In optional embodiments, a third access seam can be added. The third access seam can open fully as does the first access seam 16,17 or only partially as does the second access seam 15. Also, the garment 100 can include various other fashion design features, such as pockets 25*a*,*b* (with openings 14*a*,*b*) or a hood. Also, the neck 31 can be modified with additional access seams with mates, or be crew cut. The same principles can be applied to a lower body garment having an access seam spanning on a lateral side from a hip to an ankle.

As will be understood by those familiar with the art, the invention may be embodied in other specific forms without departing from the spirit or essential characteristics thereof. Likewise, the particular naming and division of the portions, components, functions, procedures, actions, layers, features, attributes, methodologies, other aspects are not mandatory or significant, and the mechanisms that implement the invention or its features may have different names, divisions and/or formats. The description, for purpose of explanation, has been described with reference to specific embodiments. However, the illustrative discussions above are not intended to be exhaustive or limiting to the precise forms disclosed. Many modifications and variations are possible in view of the above teachings. The embodiments were chosen and described in order to best explain relevant principles and their practical applications, to thereby enable others skilled in the art to best utilize various embodiments with or without various modifications as may be suited to the particular use contemplated.

I claim:

1. A garment for an upper body of a patient to accommodate medical equipment, the garment comprising:

a body with a first sleeve, a second sleeve and a lower hem, the first sleeve comprising a first cuff and a first armpit, and the second sleeve comprising a second cuff and a second armpit;

a first access seam spanning only a portion of the first sleeve on an underside from the first cuff to the first arm pit and spanning only a portion of the body from the first arm pit to the lower hem, the first access seam secured intermittently along the first sleeve and body to allow access to the upper body of the patient for manipulation of medical equipment; and a second access seam spanning only a portion of a top side of the second sleeve from the second cuff to a neckline, wherein the portion comprises more than half of the top side of the second sleeve, wherein the first and second cuffs are permanently tethered to prevent said first and second access seams spanning through said cuffs, the second access seam secured intermittently the second sleeve to allow access to the upper body of the patient for manipulation of medical equipment.

2. The garment of claim 1, wherein the garment is reversible from back to front, to allow access to different parts of the patient.

3. The garment of claim 1, wherein the first access seam accommodates IV tubes to span from the upper body of the patient to medical equipment external to the garment.

4. The garment of claim 1, wherein the garment is configured to remove from the patient without disturbing IV tubes spanning from the upper body of the patient to medical equipment external to the garment.

5. The garment of claim 1, wherein the garment is configured to put on the patient without disturbing IV tubes spanning from a body of the patient to medical equipment external to the garment.

6. The garment of claim 1, wherein at least one of the first and second access seams are secured by at least one of magnets and hook and loop.

7. The garment of claim 1, wherein at least one of the first and second access seams are secured by a break-away mechanism.

8. The garment of claim 1, wherein the first access seam is to completely unfastened to allow the garment to be put on and removed from the patient.

9. A method of accommodating medical equipment with a garment for an upper body of a patient, the method comprising:

providing a body with a first sleeve, a second sleeve and a lower hem, the first sleeve comprising a first cuff and a first armpit, and the second sleeve comprising a second cuff and second armpit;

allowing access to the upper body of the patient for manipulation of medical equipment with a first access seam spanning only a portion of the first sleeve on an underside from the first cuff to the first arm pit and spanning at least a portion of the body from the first arm pit to the lower hem, the first access seam secured intermittently along the first sleeve and body; and the allowing access to the upper body of the patient for manipulation of medical equipment with a second access seam spanning only a significant portion of a top side of the second sleeve from the second cuff to a neckline, wherein the significant portion comprises more than half of the top side of the second sleeve; wherein the first and second cuffs are permanently tethered to prevent the first and second access seams spanning through the cuffs, the second access seam secured intermittently along the second sleeve.

10. A garment for an upper body of a patient to accommodate medical equipment, the garment comprising:

a body with a first sleeve, a second sleeve and a lower hem, the first sleeve comprising a first cuff and a first armpit, and the second sleeve comprising a second cuff and a second armpit;

a first access seam spanning only a portion of the first sleeve on an underside from the first cuff to the first arm pit and spanning only a portion of the body from the first arm pit to the lower hem, the first access seam secured intermittently along the first sleeve and body to allow access to the upper body of the patient for manipulation of medical equipment; and a second access seam spanning only a significant portion of a top side of the second sleeve from the second cuff to a neckline, wherein the significant portion comprises more than half of the top side of the second sleeve; wherein the first and second cuffs are permanently tethered to prevent the first and second access seams spanning through the cuffs, the second access seam secured intermittently the second sleeve to allow access to the upper body of the patient for manipulation of medical equipment, wherein the first access seam and the second access seams are on opposite sleeves, and wherein each of the first access seam and the second access seam provide full patient access for medical access through the first and second sleeves without any additional access seams.

* * * * *